US006106413A

United States Patent [19]

Kusumoto

[11] Patent Number: 6,106,413

[45] Date of Patent: Aug. 22, 2000

[54] TUBULAR BODY

[75] Inventor: Harunobu Kusumoto, Saitama, Japan

[73] Assignee: Daiwa Seiko, Inc., Tokyo, Japan

[21] Appl. No.: 08/874,716

[22] Filed: Jun. 13, 1997

[30] Foreign Application Priority Data

Jun. 14, 1996 [JP] Japan ..... 8-154327

[51] Int. Cl.[7] ..... A63B 53/10

[52] U.S. Cl. ..... 473/319; 273/7; 273/23

[58] Field of Search ..... 473/319, 320; 273/DIG. 7, DIG. 23; 428/36.3; 43/18.1, 18.5; 280/819

[56] References Cited

U.S. PATENT DOCUMENTS

| | | | |
|---|---|---|---|
| 3,646,610 | 2/1972 | Jackson | 273/DIG. 7 |
| 4,567,216 | 1/1986 | Qureshi | 523/400 |
| 4,891,408 | 1/1990 | Neuman-Evans | 525/113 |
| 5,156,396 | 10/1992 | Akatsuka | 473/319 |
| 5,326,099 | 7/1994 | Yamamoto | 473/319 |
| 5,427,373 | 6/1995 | Kusumoto | 473/319 |

FOREIGN PATENT DOCUMENTS 6-7923 2/1994 Japan .

*Primary Examiner*—Jeanette Chapman
*Assistant Examiner*—Stephen L. Blau
*Attorney, Agent, or Firm*—Liniak, Berenato, Longacre & White

[57] ABSTRACT

A tubular body comprises: rolled layers of prepreg formed of reinforcing fibers impregnated with synthetic resin, wherein a ratio of impregnation of synthetic resin contained in a skew fiber body layer on which fibers are arranged in a skew direction and also a ratio of impregnation of synthetic resin contained in an axial fiber body layer on which fibers are arranged in an axial direction are in a range from a value approximately not lower than 10 wt % to a value lower than 25 wt %, and a thin layer, the ratio of impregnation of synthetic resin of which is high, is provided between the skew fiber body layer and the axial fiber body layer. The specific strength and specific rigidity of the tubular body are high, and the tubular body is less susceptible to separation and damage of the fibers and layers even if an impact force is given to it.

12 Claims, 1 Drawing Sheet

TUBULAR BODY

BACKGROUND OF THE INVENTION

The present invention relates to a tubular body made of FRP used for a golf club shaft, fishing rod, ski stick, frame of a bicycle and so forth.

In order to enhance the specific strength and the specific rigidity of a laminated body, for example, Japanese Unexamined Utility Model Publication No. 6-7923 discloses an arrangement of a body layer formed of fibers and resin, and a ratio of resin to a total of fibers and resin is 10 to 20 weight percents.

However, in the case of a tubular body such as a golf club shaft to which bending stress or torsional stress is applied and further an impact force is given when a golf ball is hit by the golf club, separation and damage tend to occur among the fibers and layers composing the shaft, or alternatively separation and damage tend to occur in a portion where parts are attached to the shaft.

SUMMARY OF THE INVENTION

It is an object of the present invention to provide a tubular body, the specific strength and the specific rigidity of which are high. It is also an object of the present invention to provide a tubular body, the specific strength and the specific rigidity of which are high, and the tubular body is less susceptible to separation and damage even if an impact force is given to it.

In the tubular body of the present invention, a ratio of impregnation of synthetic resin in prepreg on the main body layer, which is a primary component, is determined to be in a range from a value not lower than 10 wt % to a value lower than 25 wt %. When the ratio of impregnation of synthetic resin in prepreg on the main body layer is determined to be in the above range, the characteristic of reinforcing fibers can be exhibited, so that a tubular body of high specific strength and specific rigidity can be provided.

In this case, when the main body layer is formed of layers of prepreg including skew fibers arranged in a skew direction and axial fibers arranged in an axial direction, blow holes are generated in synthetic resin on an interface between the skew fiber layer and the axial fiber layer. Due to the above blow holes, separation and damage tend to occur on the main body layer. When a thin layer, the ratio of impregnation of synthetic resin of which is high, is formed between these layers, both layers are made to adhere tightly to each other, and the occurrence of separation and damage can be prevented.

When the main body layer is formed of a layer of prepreg including skew fibers arranged in a skew direction and axial fibers arranged in an axial direction, in order to enhance the specific strength and the specific rigidity, the ratio of impregnation of synthetic resin contained in prepreg of each main body layer may be reduced. However, when the ratio of impregnation of synthetic resin contained in the skew fibers is excessively reduced, a sufficiently large quantity of synthetic resin can not be provided among the fibers and layers. As a result, separation tends to occur. Accordingly, when the ratio of synthetic resin impregnated in the skew fibers is reduced to a value at which separation is not caused and also when the ratio of synthetic resin impregnated in the axial fibers is more reduced than that, it is possible to provide a tubular body, the specific strength and the specific rigidity of which are high, and separation is not caused among the fibers and on the interface.

In order to enhance the specific strength and the specific rigidity, when the ratio of impregnation of synthetic resin in prepreg on the main body layer is reduced and a layer, the ratio of impregnation of synthetic resin of which is high, is provided in a predetermined region in the axial direction (a region to which an impact force is given), it is possible to provide a tubular body, the specific strength and the specific rigidity of which are high, and also the impact resistance of which is high.

EMBODIMENTS

Figure 1:
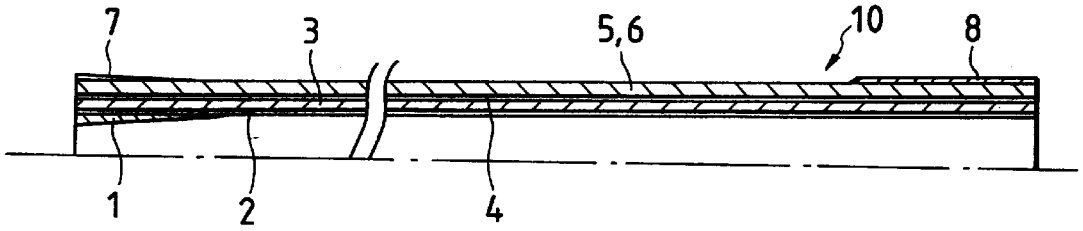
FIG. 1 is a view showing a portion of the cross-sectional structure of the tubular body.

The tubular body of the present invention comprises a main body layer which is a primary component. This main body layer includes a layer of prepreg formed of reinforcing fibers, the direction of which is arranged in an axial direction, and reinforcing fibers, the direction of which is arranged in a skew direction that is skewed by a predetermined angle with respect to the axial direction, wherein these reinforcing fibers are impregnated with synthetic resin. In order to enhance the specific strength and the specific rigidity of the tubular body, the prepreg of the main body layer is formed in such a manner that a ratio of impregnation of synthetic resin is approximately in a range from a value not lower than 10% to a value lower than 25 wt %. It is preferable that a ratio of impregnation of synthetic resin is approximately in a range from a value not lower than 10% to a value lower than 23 wt %. It is more preferable that a ratio of impregnation of synthetic resin is approximately in a range from a value not lower than 10% to a value lower than 20 wt %. In this connection, when the main body layer is formed of a layer of prepreg (AP prepreg) of fibers impregnated with synthetic resin, the direction of which is arranged in the skew direction and also formed of a layer of prepreg (SP prepreg) of fibers impregnated with synthetic resin, the direction of which is arranged in the axial direction, an average of both of them is used as the ratio of synthetic resin of impregnation.

In the present invention, in accordance with the use of the tubular body and the circumstances in which it is used, it is necessary for the main body layer, which is a primary component of the tubular body, to satisfy at least one of the following items (1) to (10). Of course, an arbitrary item may be satisfied.

(1) Between a layer of AP prepreg and a layer of SP prepreg which are the main body layers, there is provided a thin layer of prepreg of high resin (intermediate layer), the ratio of impregnation of resin of which is high with respect to AP prepreg and SP prepreg. In this case, any layer of prepreg may be located inside (outside).

When a layer of AP prepreg, the ratio of impregnation of synthetic resin of which is low, is made to closely adhere to a layer of SP prepreg, the ratio of impregnation of synthetic resin of which is also low, blow holes occur on an interface on which the fiber directions are different from each other, so that separation and damage tend to occur. However, when the thin layer of prepreg of high resin is provided between the layer of AP prepreg and the layer of SP prepreg as described above, resin flows on the interface. Therefore, it becomes difficult for blow holes to be generated on the interface. Accordingly, the occurrence of separation is prevented, and the mechanical strength between the layers can be enhanced.

An example of the thin layer of prepreg of high resin to be provided between AP prepreg layer and SP prepreg layer is a one-way sheet (UD sheet), the fiber direction of which is arranged in the circumferential direction, impregnated with synthetic resin. This prepreg is provided for the purpose of preventing the occurrence of blow holes and increasing the mechanical strength. Therefore, the sheet thickness may be smaller than the thickness of the fiber layer of an adjacent main body layer. Therefore, the sheet thickness is determined to be not more than 0.06 mm. It is preferable that the sheet thickness is determined to be not more than 0.04 mm. It is more preferable that the sheet thickness is determined to be not more than 0.02 mm. In this case, the ratio of impregnation of resin is determined to be 28 wt % to 58 wt %. The reason why the ratio of impregnation of resin is determined as described above is as follows. When the weight ratio of impregnation of resin is lower than the above range, it is impossible to prevent the generation of blow holes and the occurrence of separation. Therefore, it is impossible to enhance the mechanical strength. When the weight ratio of impregnation of resin is higher than the above range, it is impossible to provide a tubular body, the specific rigidity of which is high. When the ratio of impregnation of synthetic resin is increased, the property of working and handling is deteriorated. Therefore, it is preferable to use a piece of woven cloth instead of a UD sheet.

When the direction of fibers of the above UD sheet is arranged in the circumferential direction, it is possible to prevent a crush of the tubular body in the radial direction. Of course, the direction of fibers of the UD sheet to be used as an intermediate layer is not limited to the circumferential direction. Even if the direction of fibers of the UD sheet is set in another direction, it is possible to prevent the occurrence of separation of AP prepreg and SP prepreg on the interface.

Reinforcing fibers to be used on the intermediate layer are not limited to the above UD sheet formed of long fibers. When material such as short fibers, whiskers and grain-shaped material is used, the reinforcing direction has no anisotropy. Therefore, it is suitable when a portion to which a load is given in any direction is reinforced. Concerning the intermediate layer, instead of a thin layer of prepreg of high resin, the ratio of impregnation of synthetic resin of which is high, it is possible to provide a layer made of only synthetic resin. When there is provided a layer made of only synthetic resin, it is possible to reduce the thickness of the layer, and a quantity of resin to be charged onto the interface can be reduced.

In the above arrangement, at least one of AP prepreg and SP prepreg may be a very low resin prepreg, the ratio of impregnation of synthetic resin of which is very low, that is, the ratio of impregnation of synthetic resin is 10 wt % to 20 wt %, and the ratio of impregnation of synthetic resin is preferably 10 wt % to 18 wt %. When AP prepreg is made of a very low resin prepreg, the modulus of elasticity of shearing in the torsional direction per unit weight of material can be enhanced. Therefore, when the same torsional rigidity is provided, the weight can be reduced. When SP prepreg is made of a very low resin prepreg, the modulus of elasticity of bending per unit weight of material can be enhanced. Therefore, when the same bending rigidity is provided, the weight can be reduced.

(2) In the case of an arrangement in which a layer of SP prepreg, which is the main body layer, is arranged on the side of an outer layer, when the layer of SP prepreg composes a surface layer of the tubular body, the layer of SP prepreg is divided into two portions. One is arranged on the outer surface side which is made of high resin prepreg, and the other is arranged on the inner surface side which is made of very low resin prepreg. In other words, the layer of SP prepreg is divided in such a manner that the ratio of impregnation of synthetic resin is high on the outer surface layer side, and the ratio of impregnation of synthetic resin is low on the inner surface layer side.

Usually, onto the outer surface side, impact forces are given most frequently. Therefore, when a ratio of impregnation of synthetic resin is low on the outer surface side, cracks tend to occur due to the generation of blow holes. Further, since the outer surface side is a portion to be polished in the final finishing process, when a ratio of impregnation of synthetic resin is low, cracks tend to occur on the outer surface by lack of resin.

Consequently, when a layer of SP prepreg composes a surface layer of the tubular body, it is possible to prevent the occurrence of surface layer cracks and enhance the impact resistance by dividing the layer of SP prepreg and increasing the ratio of impregnation of resin on the surface layer side.

In the above arrangement, when the inner side layer is made of low resin prepreg, the ratio of impregnation of synthetic resin of which is 10 wt % to 20 wt %, the ratio of impregnation of synthetic resin of high resin prepreg to be located on the outside is 25 wt % to 35 wt %. Therefore, it is preferable that a ratio of the synthetic resin impregnated on the outer layer, to the synthetic resin impregnated on the inner layer is approximately 1.5 times (1.2 to 2 times).

In this connection, even after the layer of SP prepreg has been divided in the above manner, or alternatively when the layer of SP prepreg is not divided, it is possible that a layer of prepreg, the ratio of impregnation of synthetic resin of which is high (the fiber direction and the thickness are arbitrarily determined), may be provided as a reinforcing layer on the surface layer side. In this case, it is preferable that the ratio of impregnation of synthetic resin of SP prepreg is approximately 10 wt % to 20 wt %, and that the ratio of impregnation of synthetic resin of high resin prepreg to be used as a reinforcing layer is approximately 25 wt % to 35 wt %.

On the contrary, in the case of an arrangement in which a layer of AP prepreg, which is the main body side layer, is arranged on the outer layer side, when the layer of AP prepreg composes a surface layer of the tubular body, the same arrangement as that described above may be adopted.

(3) In the case of an arrangement in which a layer of AP prepreg, which is the main body layer, is arranged inside, when the layer of AP prepreg composes an inner layer portion of the tubular body, the layer of AP prepreg is divided in such a manner that the inside layer is a high resin prepreg, and the outside layer is a very low resin prepreg, wherein the inside layer of high resin prepreg is directly wound round a mandrel.

Usually, a portion which is directly wound round a mandrel is not in a good condition compared with other portions, because a mold releasing agent and an adhesive agent are coated on the portion. Accordingly, when a layer of AP prepreg, the ratio of impregnation of resin of which is low, is wound round this portion, blow holes are generated, and when the mandrel is removed from the layer of AP prepreg, cracks tend to occur on the surface.

Accordingly, when the inner layer of the tubular body is made of AP prepreg, it is possible to prevent the occurrence of cracks on the surface layer by dividing the layer of AP prepreg and increasing a ratio of impregnation of resin on the inner layer.

In the above arrangement, when the outer layer is made of very low resin prepreg, the ratio of impregnation of synthetic resin of which is 10 wt % to 20 wt %, the ratio of impregnation of synthetic resin of high resin prepreg to be located on the inner layer is 25 wt % to 35 wt %. Therefore, it is preferable that a ratio of the synthetic resin impregnated on the inner layer, to the synthetic resin impregnated on the outer layer is approximately 2 times (1.2 to 3 times).

In this connection, even after the layer of AP prepreg has been divided in the above manner, or alternatively when the layer of AP prepreg is not divided, it is possible that a layer of prepreg, the ratio of impregnation of synthetic resin of which is high (the fiber direction and the thickness are arbitrarily determined), may be provided as a reinforcing layer on the inner layer side. In this case, when a layer of prepreg of high resin is wound so that the fiber direction of the reinforcing layer can be set in the circumferential direction, it is possible to prevent the occurrence of a crush of the tubular body, and the rigidity and the mechanical strength of the inner layer can be enhanced. In the case of providing a reinforcing layer in the above manner, when the ratio of impregnation of synthetic resin of AP prepreg is determined to be in a very low range of 10 wt % to 20 wt %, it is preferable that the ratio of impregnation of synthetic resin of high resin prepreg to be formed into the reinforcing layer is determined to be 28 wt % to 58 wt %. Alternatively, this reinforcing layer may be formed in such a manner that a tape-shaped narrow prepreg made of inorganic fibers such as carbon fibers or organic fibers is spirally wound in a dense condition.

On the contrary, in the case of an arrangement in which a layer of SP prepreg, which is the main body side layer, is arranged on the inner layer side, when the layer of SP prepreg composes an inner layer of the tubular body, the same arrangement as that described above may be adopted.

(4) As described above, in order to enhance the specific strength and the specific rigidity of the tubular body, the ratio of impregnation of synthetic resin of prepreg composing the main body layer may be reduced. However, in the case where the main body layer is formed of both AP prepreg and SP prepreg, when the ratios of impregnation of synthetic resin of both of them are reduced in the same manner, since the fibers of AP prepreg are skewed, separation tends to occur among the layers and fibers due to the lack of resin. That is, when the ratio of impregnation of synthetic resin of AP prepreg is reduced in a range so that separation can not occur among the layers and fibers, it is possible to reduce the ratio of impregnation of synthetic resin of SP prepreg more than that.

When the ratios of impregnation of synthetic resin of both prepreg are reduced in the same manner, separation tends to occur between the layers due to the generation of blow holes on the interface. However, when one of the layers is made of high resin, synthetic resin flows on the interface, so that the generation of blow holes can be prevented and separation of both prepreg on the interface can be prevented.

Consideration is given to the above point, and AP prepreg which is the main body layer is formed of low resin and SP prepreg is formed of very low resin. Due to the above composition, the following effects can be provided. It is possible to enhance the specific strength and the specific rigidity of a tubular body. It is also possible to prevent the generation of blow holes on the interface because synthetic resin flows on the interface due to a difference of the ratio of impregnation of synthetic resin between them. Therefore, it becomes possible to prevent the separation on the interface between them.

That is, when the ratio of impregnation of synthetic resin of AP prepreg is reduced to a limit at which separation is not caused, and also when the ratio of impregnation of synthetic resin of SP prepreg is reduced to a value lower than that, it is possible to obtain a tubular body, the specific strength and specific rigidity of which are high, and separation is not caused among fibers, layers and interfaces.

Specifically, the ratio of impregnation of synthetic resin can be determined as follows. For example, when the ratio of impregnation of synthetic resin of AP prepreg is determined to be approximately 15 wt % to 20 wt % so that separation can not be caused, the ratio of impregnation of synthetic resin of SP prepreg can be determined to be approximately 10 wt % to 15 wt % which is lower than the ratio of impregnation of synthetic resin of AP prepreg. Due to the foregoing, it is possible to obtain a tubular body, the specific strength and specific rigidity of which are high, and separation is not caused among fibers, layers and interfaces.

In this connection, in the above composition, when a layer of AP prepreg is arranged on the outer layer side, the polar moment of inertia of area of the layer of AP prepreg is increased, so that it becomes possible to obtain a tubular body capable of resisting a high intensity of torsion. When a layer of AP prepreg is arranged on the inner layer side, the geometrical moment of inertia of the layer of AP prepreg (in the axial direction) is increased, so that it becomes possible to obtain a tubular body capable of resisting a high intensity of bending.

(5) For example, in a tube shaped body such as a golf club, to the end portion of which an impact force is given, a layer of reinforcing prepreg is wound round the end portion. In this case, at least one of the layers of AP and SP prepreg, which are the main body layers, is formed of very low resin, the ratio of impregnation of synthetic resin of which is 10 wt % to 20 wt %, so that the specific strength and the specific rigidity can be enhanced, and a layer of reinforcing prepreg is formed in such a manner that the ratio of impregnation of synthetic resin can be not lower than 25 wt %.

When the ratio of impregnation of synthetic resin is high on a layer of prepreg arranged in a portion to which an impact force is given, it is possible to enhance the mechanical strength to resist an impact force. Therefore, when the ratios of impregnation of synthetic resin on the layers of AP and SP prepreg, which are the main body layers, are reduced, and also when a layer of reinforcing prepreg, the ratio of impregnation of synthetic resin of which is high, is wound round a portion to which an impact force is given, it is possible to obtain a tubular body, the specific strength and the specific rigidity of which are high, and the impact resistance of which is enhanced.

In this case, the layer of prepreg used for reinforcing an end portion may be arranged on any of the innermost layer, the intermediate layer and the outermost layer. Further, a plurality of layers of prepreg used for reinforcing an end portion may be wound round the shaft. The direction of fibers of prepreg used for reinforcing, and the length of prepreg in the axial direction are not particularly specified.

(6) When the tubular body is used for a golf club shaft, the reinforcing layer is provided in a portion where an impact force is given, that is, the reinforcing layers are provided in a tip portion to which a head is attached and a butt portion to which a grip is attached. In this specification, the tip portion is defined as a portion where a reinforcing layer to reinforce a fore end portion of the golf club shaft is provided, and the butt portion is defined as a portion where a reinforcing layer to reinforce a base end portion (grip portion) of the golf club shaft is provided, and other portions are defined as an intermediate portion.

A ratio of impregnation of synthetic resin of the overall prepreg composing the golf club shaft including the reinforcing layer is determined to be a value lower than 30 wt %, and a ratio of the impregnation of synthetic resin of prepreg in the tip portion, to the impregnation of synthetic resin of prepreg in the butt portion, is determined to be approximately 1 to 0.9. In this case, the reinforcing layer in the tip portion and the butt portion may be arranged in any of the innermost layer, the intermediate layer and the outermost layer, and a plurality of reinforcing layers may bewound. The direction of fibers of reinforcing prepreg and the length in the axial direction are not particularly specified.

As described above, the ratio of impregnation of synthetic resin of the overall prepreg composing the golf club shaft including the reinforcing layer is determined to be a value lower than 30 wt %, and due to the reinforcing layer arranged in the tip and the butt portion, it is possible to provide a golf club shaft, the specific strength and the specific rigidity of which are high, and the impact resistance of which is enhanced. When the ratio of impregnation of synthetic resin of prepreg in the tip portion is made to be higher than that of impregnation of synthetic resin of prepreg in the butt portion, it is possible to provide a golf club shaft characterized in that: the mechanical strength of the portion to which the head is attached is enhanced; and the vibration absorbing effect in the tip portion is high, so that vibration is not transmitted to a golfer's hand; and the generation of cracks caused by blow holes can be prevented.

Especially, it is preferable that a ratio of impregnation of synthetic resin is continuously reduced in a portion from the tip end (the head attaching portion) to a position distant from the tip end by about 300 mm. In this case, a ratio of impregnation of synthetic resin may be reduced continuously. Alternatively, it may be reduced stepwise. The reason is that an intensity of the impact force generated when a ball has been hit is maximum in the head attaching portion, and it is decreased at a position distant from the head attaching portion. At a position distant from the head attaching portion by about 300 mm, an intensity of the impact force generated when a ball has been hit is converged.

(7) The ratio of impregnation of synthetic resin of the overall prepreg composing the golf club shaft including the reinforcing layer is determined to be a value lower than 30 wt %, and the ratios of impregnation of synthetic resin of prepreg of the tip portion, intermediate portion and butt portion are determined to be tip portion>butt portion>intermediate portion. In this case, the reinforcing layer may be arranged on any of the innermost layer, the intermediate layer and the outermost layer, and a plurality of reinforcing layers may be wound. The direction of fibers of reinforcing prepreg and the length in the axial direction are not particularly specified. The ratio of impregnation of synthetic resin in a region from the tip portion to the butt portion may be changed continuously or stepwise.

When the ratio of impregnation of synthetic resin of the overall prepreg including the reinforcing layer is determined to be lower than 30 wt %, the same effect as that of the above item (6) can be provided. When the ratios of impregnation of synthetic resin of layers of prepreg composing the golf club shaft are determined to be tip portion>butt portion>intermediate portion, it is possible to provide a golf club shaft characterized in that: the specific strength and the specific rigidity are high; and the impact resistance is high in a portion of the golf club shaft where a high impact resistance is required.

(8) The ratio of impregnation of synthetic resin of the overall prepreg of AP and SP composing the main body layer of the golf club shaft is determined to be 10 wt % to 23 wt %. In a portion of the golf club shaft, in this case, in the grip portion of the golf club shaft, a reinforcing layer made of high resin prepreg (the ratio of impregnation of synthetic resin is not lower than 30 wt %, and preferably the ratio of impregnation of synthetic resin is not lower than 40 wt %) is formed.

The grip portion of a golf club shaft is a portion to which an impact force is given. Therefore, when the reinforcing layer is formed from high resin prepreg in this grip portion, it is possible to provide a golf club shaft characterized in that: the specific strength and the specific rigidity are high; the impact resistance can be enhanced; and the vibration given to the shaft can be absorbed. In this case, the reinforcing layer may be arranged on any of the innermost layer, the intermediate layer and the outermost layer. Further, a plurality of the reinforcing layers may be wound round the shaft. The direction of fibers of prepreg used for reinforcing, and the length of prepreg in the axial direction are not particularly specified.

(9) The ratio of impregnation of synthetic resin of the overall prepreg of AP and SP composing the main body layer of the golf club shaft is determined to be 10 wt % to 23 wt %. In a portion of the golf club shaft, in this case, in the head attaching portion to which the head is attached, a reinforcing layer made of high resin prepreg (the ratio of impregnation of synthetic resin is not lower than 30 wt %, and preferably the ratio of impregnation of synthetic resin is not lower than 40 wt %) is formed.

The head attaching portion of a golf club shaft is a portion to which an impact force is given. Therefore, when the reinforcing layer is formed from high resin prepreg in this head attaching portion, it is possible to provide a golf club shaft characterized in that: the specific strength and the specific rigidity are high; the impact resistance can be enhanced; and the vibration given to the shaft can be absorbed. In this case, the reinforcing layer may be arranged on any of the innermost layer, the intermediate layer and the outermost layer. Further, a plurality of the reinforcing layers may be wound round the shaft. The direction of fibers of prepreg used for reinforcing, and the length of prepreg in the axial direction are not particularly specified.

(10) The ratio of impregnation of synthetic resin of the overall prepreg of AP and SP composing the main body layer of the golf club shaft is determined to be 10 wt % to 23 wt %. In a portion of the golf club shaft, in this case, on the outermost layer of the shaft, a layer made of high resin prepreg (the ratio of impregnation of synthetic resin is not lower than 30 wt %, and preferably the ratio of impregnation of synthetic resin is not lower than 40 wt %) is formed.

This layer corresponds to an allowance for polishing in the final polishing process. When this layer is provided, it is possible to reduce an amount of polishing the layer of prepreg of the main body, or alternatively it is possible to avoid an amount of polishing the layer of prepreg of the main body. Therefore, it is possible to prevent fluctuation of the physical property such as rigidity of a tubular body.

It is possible to compose the layer of prepreg satisfying the above items (1) to (10) by the following materials.

Examples of usable materials to compose the reinforcing layer are: inorganic fiber such as glass fiber, carbon fiber and boron fiber; and organic fiber such as aramid fiber and polyetherimide fiber. Examples of usable materials to compose the matrix are: thermosetting synthetic resins such as epoxy; and other thermoplastic synthetic resins.

Concerning the layer of prepreg to be used as the main body layer and also concerning the layer of prepreg to be used as the reinforcing layer, the number of plies and the thickness are variously changed in accordance with the use and the required characteristics.

EXAMPLE

Referring to the accompanying drawings, an example of the tubular body satisfying the above items will be explained as follows. In this connection; the tubular body of this example is used for a golf club shaft.

Figure 2:
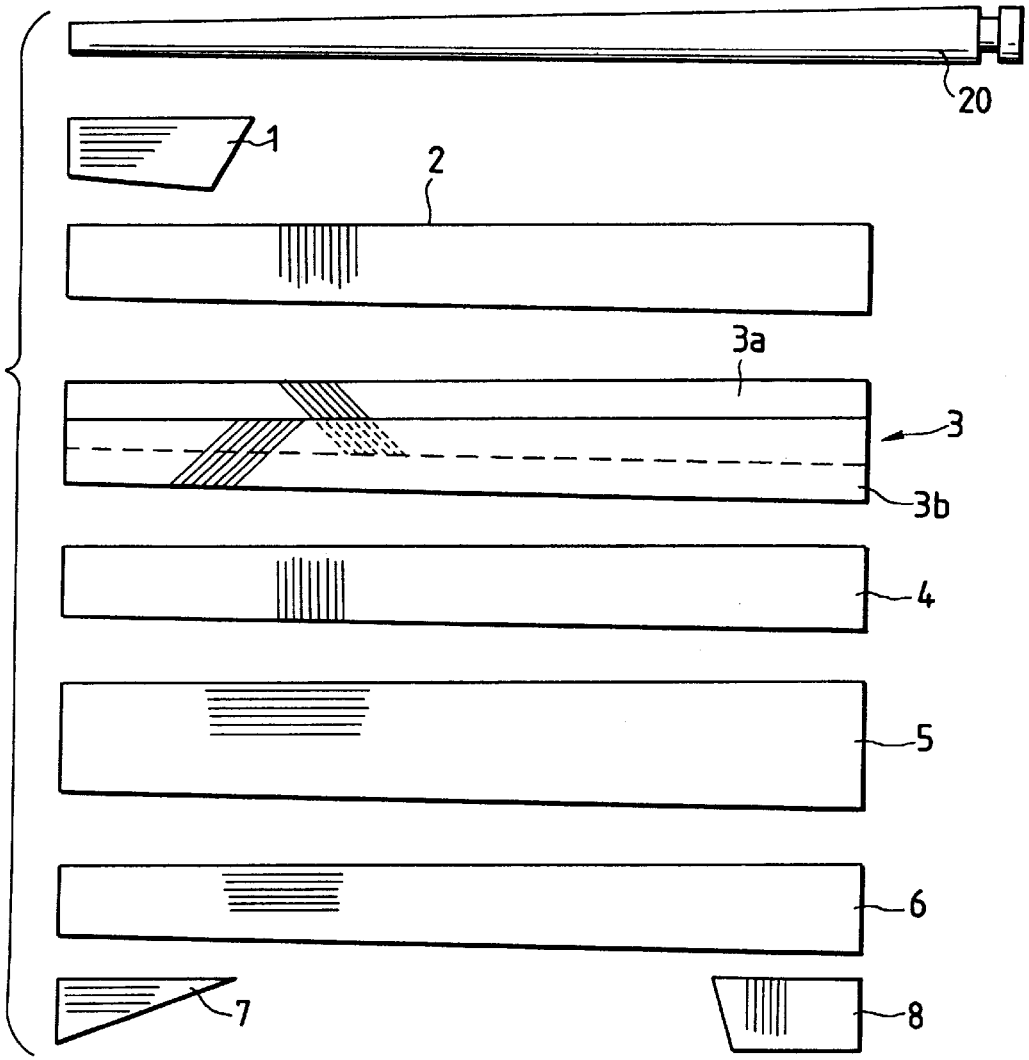
FIG. 2 is a view showing a composition of sheets of prepreg wound round a mandrel when the tubular body illustrated in FIG. 1 is manufactured.

FIG. 1 is a cross-sectional view showing a portion of the section of the golf club shaft 10 which is a tubular body. The golf club shaft having the sectional arrangement illustrated in FIG. 1 is made in the following manner. Layers of prepreg represented by reference numerals 1 to 8 are successively wound round the mandrel 20 illustrated in FIG. 2. Alternatively, the adjoining layers of prepreg are appropriately put on each other and wound round the mandrel 20. Then the layers of prepreg are subjected to the conventional method including the steps of fastening to be conducted by taping, hardening to be conducted by heating, removing the mandrel from the layers of prepreg, removing the tape, and polishing. The direction of lines illustrated on each layer of prepreg indicates the direction of fibers of prepreg. The number of plies is variously changed in accordance with the use and the required characteristic. In the example illustrated in the drawings, the essential main body layer is formed of a layer of AP prepreg 3 arranged on the inner layer side and layers of SP prepreg 5, 6 arranged on the outer layer side.

The golf club shaft of the example illustrated in FIG. 1 will be explained below in the order of layers of prepreg to be wound.

In the drawings, reference numeral 1 is a layer of prepreg used for reinforcing an end portion of the shaft. This layer of prepreg 1 may be a UD sheet, the carbon fibers of which are arranged in the axial direction as illustrated in the drawing. Alternatively, this layer of prepreg 1 may be a piece of woven cloth or a combination of a piece of woven cloth with a UD sheet. The direction of fibers is not limited to an axial direction illustrated in the drawing, but the direction of fibers may be a circumferential direction or a skew direction. When the direction of fibers is made to coincide with the circumferential direction, the mechanical strength to resist a crush of the shaft can be enhanced. When the direction of fibers is skew, the mechanical strength in the direction of torsion can be enhanced.

The ratio of impregnation of synthetic resin of the layer of prepreg 1 is higher than the ratio of impregnation of the main body layer described later. Specifically, the ratio of impregnation of synthetic resin is not lower than about 28 wt %, and preferably the ratio of impregnation of synthetic resin is not lower than about 40 wt %. When the ratio of impregnation of synthetic resin is not lower than about 40 wt %, it is possible to prevent the layer from adhering to the mandrel 20, so that the mandrel can be easily removed from the layer, and further the generation of blow holes can be prevented and no separation is caused.

Thickness of the layer of prepreg 1 may be arbitrarily determined, however, from the viewpoint of preventing the generation of step portions and the occurrence of snaking, it is preferable that the layer of prepreg 1 is thinner than the main body layer of prepreg. In this connection, when a layer of reinforcing prepreg is wound in a portion in the axial direction except for the end portion of the shaft, the aforementioned arrangement can be adopted.

It is preferable that the modulus of elasticity of fibers composing the layer of prepreg 1 is lower than that of fibers composing the layers of SP prepreg 5, 6 of the main body layer. When the fibers, the modulus elasticity of which is lower than that of the fibers composing the layers of SP prepreg 5, 6, are used, it is possible to provide the effects of enhancing the bending strength, shearing strength and impact resistance. The specific gravity of the fibers composing the layer of prepreg 1 is usually determined to be lower than the specific gravity of the fibers of layers of prepreg used for the main body layer and the reinforcing layer arranged on the grip side. However, for the purpose of adjusting the weight balance of the entire shaft, the specific gravity of the fibers of the layer of prepreg 1 may be higher than the specific gravity of the fibers of layers of prepreg used for the main body layer and the reinforcing layer arranged on the grip side.

In the drawing, reference numeral 2 is the innermost layer of prepreg arranged on the inner layer side of AP prepreg. This layer may be formed of a UD sheet, the carbon fibers of which are arranged in the circumferential direction. Concerning this innermost layer of prepreg, in order to prevent the mandrel from adhering to the layer of prepreg and also to prevent blow holes from being generated on the surface, the ratio of impregnation of synthetic resin is preferably 28 wt % to 58 wt % which is higher than the ratio of impregnation of synthetic resin of the low resin main body layer. However, it also is possible to use a layer of prepreg, the ratio of impregnation of synthetic resin of which is the same as that of impregnation of synthetic resin of the low resin main body layer.

The thickness of the innermost layer of prepreg 2 may be arbitrarily determined. However, in order to prevent the specific strength and the specific rigidity of the entire shaft from deteriorating, it is preferable that the innermost layer of prepreg 2 is thinner than the main body layer of low resin. The modulus of elasticity of fibers of prepreg 2 is lower than that of fibers of the main body layer of SP prepreg. However, in order to enhance the mechanical strength to resist a crush of the shaft, the modulus of elasticity of prepreg 2 may be the same as that of the main body layer of SP prepreg, or alternatively the modulus of elasticity of prepreg 2 may be higher than that of the main body layer of SP prepreg.

The innermost layer of prepreg 2 is provided as a reinforcing layer. Therefore, the direction of its fibers is not restricted. Instead of using a layer of prepreg, for example, a tape-shaped prepreg made of inorganic fiber such as carbon fiber and organic fiber may be spirally wound round the shaft.

In the drawing, reference numeral 3 is a layer of AP prepreg which composes the main body layer. This layer of AP prepreg 3 is formed of two layers of prepreg 3*a*, 3*b*, the directions of fibers of which are preferably skewed in the two directions of ±45° with respect to the axial direction so that the shaft can be twisted in any direction. As illustrated in the drawing, it is preferable that these layers of prepreg overlap each other by a half ply so that these layers of prepreg can be alternately wound. In this case, the directions of fibers of the layers of prepreg 3*a*, 3*b* are not restricted to ±45°. The angle may be determined to be in a range from 30° to 55° (−30° to −55°) with respect to the axial direction. It is also possible that the angle exceeds the above range.

The ratio of impregnation of synthetic resin of the layer of AP prepreg 3 is determined to be approximately 10 wt % to 23 wt %. However, the ratio of impregnation of synthetic resin of the layer of AP prepreg 3 may exceed the above range. When the layer of AP prepreg 3 is wound on the inner layer side of the layers of SP prepreg 5, 6 composing the main body layer as illustrated in the drawing, blow holes tend to be generated. Therefore, it is preferable that the ratio of impregnation of synthetic resin of AP prepreg 3 is higher than that of SP prepreg 5, 6. On the contrary, when the layer of AP prepreg 3 is wound on the outer layer side of the layers of SP prepreg 5, 6 composing the main body layer, blow holes also tend to be generated. Therefore, it is preferable that the ratio of impregnation of synthetic resin of AP prepreg 3 is higher than that of SP prepreg 5, 6.

Thickness of the layer of AP prepreg 3 may be arbitrarily determined. However, for the reason that the fibers are arranged being skewed with respect to the axial direction, it is preferable that the layer of AP prepreg 3 is thinner than the layer of SP prepreg composing the main body layer, and it is also preferable that the number of winding of the layer of AP prepreg 3 is increased. On the contrary, the layer of AP prepreg 3 may be thicker than the layer of SP prepreg composing the main body layer. However, in the case where the directions of fibers are determined so that the layers of AP prepreg can overlap each other, in order to prevent the deviation of thickness, it is preferable that the thickness of the layer of AP prepreg 3 is the same as that of the main body layer formed of the layer of SP prepreg, or alternatively the thickness of the layer of AP prepreg 3 is not larger than a value which is twice as large as that of the main body layer formed of the layer of SP prepreg.

Concerning AP prepreg 3, for the reasons that the bending elasticity is not lowered and the torsional rigidity can be effectively enhanced, it is preferable that the elasticity of fibers of the layer of AP prepreg 3 is higher than that of fibers of the layer of SP prepreg of the main body layer. When the direction of fibers is skewed with respect to the axial direction, the modulus of bending elasticity is sharply lowered. For the above reason, material of AP prepreg is selected so that the modulus of elasticity of AP prepreg can be higher than the modulus of elasticity of SP prepreg by a value not lower than 10 ton/mm$^2$ and preferably by a value not lower than 20 ton/mm$^2$. That is, the modulus of elasticity of AP prepreg is preferably determined to be high in the following manner. When the modulus of elasticity of fibers composing SP prepreg is 30 ton/mm$^2$, the modulus of elasticity of fibers composing AP prepreg is 30 to 70 ton/mm$^2$.

Concerning the main body layer, the ratio of impregnation of synthetic resin of which is low, the smaller the diameter of reinforcing fibers is, the higher the effect can be enhanced. For example, in the case of carbon fibers, it is preferable that the average diameter of reinforcing fibers is not larger than 5.5$\mu$. The reason is described as follows. When the average diameter of fibers is large, synthetic resin is not sufficiently charged among the fibers, and blow holes tend to be generated in synthetic resin, and further blow holes tend to be generated between the layers.

In the drawing, reference numeral 4 is an intermediate layer (buffer layer) interposed between the layer of AP prepreg 3, which is the main body layer, and the layers of SP prepreg 5, 6. This intermediate layer 4 is formed in such a manner that a UD sheet, the carbon fibers of which are arranged in the circumferential direction, is impregnated with synthetic resin, and the thus obtained UD sheet is wound by a predetermined number of plies. In this connection, when it is necessary to increase a ratio of impregnation of synthetic resin, it is preferable to use a piece of woven cloth. Reinforcing fibers to be used on the intermediate layer are not limited to the above UD sheet formed of long fibers. In this connection, reinforcing fibers are not limited to long fibers. Material such as short fibers, whiskers and grain-shaped material may be used. This intermediate layer may be made of only synthetic resin.

In the case where the intermediate layer is made of prepreg, the ratio of impregnation of synthetic resin is made to be higher than that of impregnation of synthetic resin of the main body layer (AP prepreg 3 and SP prepreg 5, 6). Specifically, when the ratio of impregnation of synthetic resin of the main body layer is 10 wt % to 23 wt %, the intermediate layer is formed in such a manner that a sheet of which the carbon fibers are arranged in a predetermined direction is impregnated with synthetic resin by a ratio of 28 wt % to 58 wt %. In this case, it is preferable that the sheet thickness is not larger than 0.06 mm, and it is more preferable that the sheet thickness is not larger than 0.04 mm (further not larger than 0.02 mm). The number of winding is determined so that the thickness of the intermediate layer can be sufficiently larger than the thickness of the adjoining main body layer.

Concerning the intermediate layer 4, an area of the intermediate layer 4 coming into contact with synthetic resin is larger than an area of the intermediate layer 4 coming into contact with the fibers of the adjoining main body layer. In this case, all intermediate layer 4 may come into contact with synthetic resin. It is preferable that an area of the intermediate layer 4 not lower than 80% is a contact interface. When fibers are used as a reinforcing material of the intermediate layer 4, the modulus of elasticity of fibers (or the modulus of elasticity of prepreg) is determined to be 24 to 60 ton/mm$^2$. Therefore, the fibers are arranged being skewed so that the bending strength can be the same as that of the adjoining main body layer or the bending strength can be lower than that of the adjoining main body layer. Alternatively, it is preferable to use a material, the rupture elongation of which is high.

In the drawing, reference numerals 5 and 6 are layers of SP prepreg composing the main body layer. On the layers of SP prepreg, the carbon fibers are arranged in the axial direction. In this example, the layer of SP prepreg is divided into a plurality of pieces. The layer of prepreg 6 on the surface layer side is made of high resin, and the layer of prepreg 5 on the inner layer side is made of very low resin. Specifically, the ratio of impregnation of synthetic resin of prepreg 5 provided on the inner layer side is approximately 10 wt % to 20 wt %, and the ratio of impregnation of synthetic resin of prepreg 6 provided on the surface layer side is approximately 25 wt % to 35 wt %.

In this example, the thickness of SP prepreg is in a range from 0.05 mm to 0.25 mm. However, the thickness of SP prepreg is not limited to the above range. Concerning the direction of fibers, it is possible to skew the fibers in a range of ±5° or ±15°. Concerning the reinforcing layer, it is preferable to use fibers of high density, the modulus of elasticity of which is high. When the main body layer is divided into a plurality of layers as described in this example, it is preferable that the mechanical strength of the outer layer is higher than that of the inner layer and it is also preferable that the inner layer is made of fibers (prepreg) of high elasticity.

A very thin layer of fibers arranged in the circumferential direction, the thickness of which is not larger than 0.06 mm, may be provided, or alternatively a string-shaped body of fibers may be spirally wound. In this case, the ratio of impregnation of synthetic resin of the thus provided layer is made to be higher than that of the layer of SP prepreg composing the main body layer. When the aforementioned layer is formed outside the layer of SP prepreg, it is possible to protect the main body layer and improve the outer appearance.

In the drawing, reference numeral 7 is a sheet of prepreg to reinforce an end portion of the shaft, and reference numeral 8 is a sheet of prepreg to reinforce a grip portion of the shaft. These sheets of prepreg used for reinforcement are formed in the same manner as that of the sheet of prepreg 1.

According to the above composition, it is possible to provide a golf club shaft characterized in that: the specific strength and the specific rigidity are high, so that separation and damage are not caused; and the impact resistance is enhanced. When a reinforcing layer, the ratio of impregnation of synthetic resin of which is high, is formed in the axial direction, it is possible to enhance the mechanical strength of a region to which parts are attached, adjust a position of the kick point, and absorb the vibration. Further, it becomes possible to improve golfer's feeling when he hits a ball.

When the golf club shaft of the example described above is made, a ratio of impregnation of synthetic resin of prepreg is changed in the axial direction continuously or stepwise in such a manner that the ratio of impregnation of synthetic resin of prepreg is increased in the order of intermediate portion <grip portion < heat attaching portion. Due to the foregoing, it is possible for a golfer to swing the golf club lightly and sharply, and vibration can be absorbed in the grip portion, and golfer's feeling can be improved when he hits a ball.

Effect of the Invention

According to the present invention, it is possible to provide a tubular body, the specific strength and specific rigidity of which are high. Even if an impact force is given to the tubular body, no separation and damage are caused among the fibers and layers.

What is claimed is:

1. A tubular body comprising:

a skew layer formed of fiber reinforced fibers impregnated with synthetic resin, said skew layer having fibers substantially oriented in a skew direction and having a ratio of impregnation of synthetic resin within a range between ten percent and twenty percent by weight;

an axial layer formed of fiber reinforced fibers impregnated with synthetic resin, said axial layer having fibers substantially oriented in an axial direction and having a ratio of impregnation of synthetic resin within a range between ten percent and twenty percent by weight; and an intermediate layer disposed between said skew layer and said axial layer, said intermediate layer having a ratio of impregnation of synthetic resin within a range between twenty eight percent to fifty eight percent by weight.

2. A tubular body according to claim 1, wherein said intermediate layer further comprises reinforcing fibers substantially oriented in a circumferential direction.

3. A tubular body according to claim 2, wherein said intermediate layer has a thickness less than 0.04 mm.

4. A tubular body according to claim 1, wherein one of said skew layer and said axial layer has a ratio of impregnation of synthetic resin within a range between ten percent and eighteen percent by weight.

5. A tubular body according to claim 1, wherein said tubular body has an overall ratio of impregnation of synthetic resin less than thirty percent by weight.

6. A tubular body according to claim 1, wherein said reinforcing fibers of said skew layer has a modulus of elasticity at least ten ton/mm$^2$ higher than a modulus of elasticity of said reinforcing fibers of said axial layer.

7. A tubular body according to claim 4, wherein said reinforcing fibers of said skew layer has a modulus of elasticity greater than twenty ton/mm$^2$.

8. A tubular body according to claim 7, wherein said intermediate layer comprises reinforcing fibers having a modulus of elasticity within a range between twenty four and sixty ton/mm$^2$.

9. A tubular body according to claim 8, further comprising:

a second axial layer having reinforcing fibers substantially oriented in said axial direction disposed radially outward with respect to said axial layer, said second axial layer having a ratio of impregnation of synthetic resin within a range between twenty five percent and thirty five percent by weight.

10. A tubular body according to claim 1, wherein said ratio of impregnation of synthetic resin of said stew layer is within a range between fifteen percent and twenty percent by weight and said ratio of impregnation of synthetic resin of said axial layer is within a range between ten percent and fifteen percent by weight.

11. A tubular body according to claim 1, said tubular body having a grip end, a head attaching end and an intermediate portion disposed therebetween, said grip end and said head attaching end each having a reinforcing layer having a ratio of impregnation of synthetic resin greater than thirty percent by weight and an overall ratio of impregnation of synthetic resin of said grip portion is greater that an overall ratio of impregnation of synthetic resin of said intermediate portion and an overall ratio of impregnation of synthetic resin of said head attaching portion is greater than said overall ratio of impregnation of synthetic resin of said grip portion.

12. A tubular body according to claim 1, wherein said ratio of impregnation of synthetic resin of said layer provided in said predetermined region in the axial direction is greater than 40% by weight.

* * * * *